US011820156B2

(12) United States Patent
Hitzlsperger et al.

(10) Patent No.: US 11,820,156 B2
(45) Date of Patent: Nov. 21, 2023

(54) METHOD AND DEVICE FOR INCREASING THE PRINT QUALITY OF AN INKJET PRINTING DEVICE

(71) Applicant: Canon Production Printing Holding B.V., Venlo (NL)

(72) Inventors: Florian Hitzlsperger, Poing (DE); Ulrich Stöckle, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 17/381,686

(22) Filed: Jul. 21, 2021

(65) Prior Publication Data

US 2022/0024221 A1 Jan. 27, 2022

(30) Foreign Application Priority Data

Jul. 23, 2020 (DE) ..... 102020119455.2

(51) Int. Cl.

*B41J 2/21* (2006.01)
*B41J 2/14* (2006.01)
*B41J 2/045* (2006.01)

(52) U.S. Cl.

CPC ..... *B41J 2/2146* (2013.01); *B41J 2/04505* (2013.01); *B41J 2/14* (2013.01); *B41J 2/2142* (2013.01)

(58) Field of Classification Search

CPC ..... B41J 2/14427; B41J 2/14; B41J 2/2142; B41J 2/2146; B41J 2/2132; B41J 2/2139; B41J 2/2135; B41J 2/04558; B41J 2/04505; B41J 29/38; B41J 2/04593; B41J 2/04588; B41J 2/04581

See application file for complete search history.

(56) References Cited

U.S. PATENT DOCUMENTS

2012/0287208 A1* 11/2012 Kobashi ..... B41J 29/38 347/68
2018/0099510 A1 4/2018 Niino

FOREIGN PATENT DOCUMENTS

JP 201851952 A 4/2018
JP 2018051952 A * 4/2018

OTHER PUBLICATIONS

German Office Action dated Feb. 12, 2021, German Patent Application No. 10 2020 119 455.2.

* cited by examiner

*Primary Examiner* — Jannelle M Lebron
(74) *Attorney, Agent, or Firm* — THE WEBB LAW FIRM

(57) ABSTRACT

In a method and system for increasing print quality, activation pulses are activated with which a nozzle of an inkjet printing device to print dots on a recording medium. The activation pulses may be adapted based on sensor data with respect to already printed dots. The method and system can further include an automatic adaptation of the activation pulses to increase print quality even given the presence of soiling at the nozzle.

12 Claims, 3 Drawing Sheets

METHOD AND DEVICE FOR INCREASING THE PRINT QUALITY OF AN INKJET PRINTING DEVICE

CROSS REFERENCE TO RELATED APPLICATIONS

This patent application claims priority to German Patent Application No. 10 2020 119 455.2, filed Jul. 23, 2020, which is incorporated herein by reference in its entirety.

BACKGROUND

Field

The disclosure relates to an inkjet printing device. In particular, the disclosure relates to a method and a corresponding device with which the activation pulses of the one or more nozzles of the inkjet printing device may be adapted during operation in order to increase the print quality.

Related Art

An inkjet printing device for printing to a recording medium may comprise one or more print heads having respectively one or more nozzles. The nozzles are respectively configured to eject ink droplets in order to print dots of a print image on the recording medium. The one or more print heads and a recording medium are thereby moved relative to one another in order to print dots at different positions on the recording medium, in particular in different lines.

During the operation of an inkjet printing device, negative effects on the droplet formation of individual nozzles may occur, whereby the print quality of the printing device is negatively affected.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
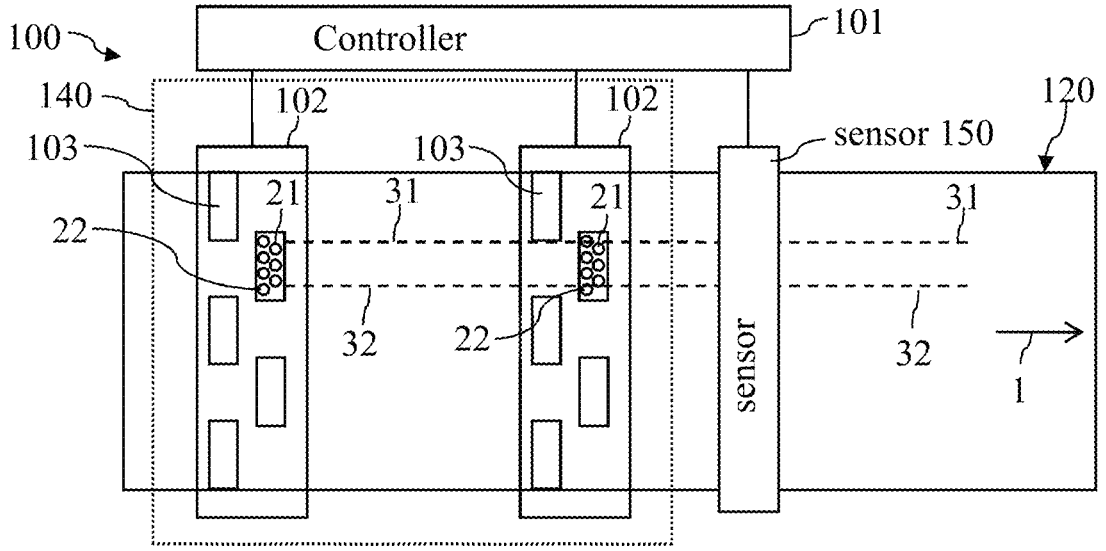

FIG. 1 a block diagram of an inkjet printing device according to an exemplary embodiment.

Figure 2:
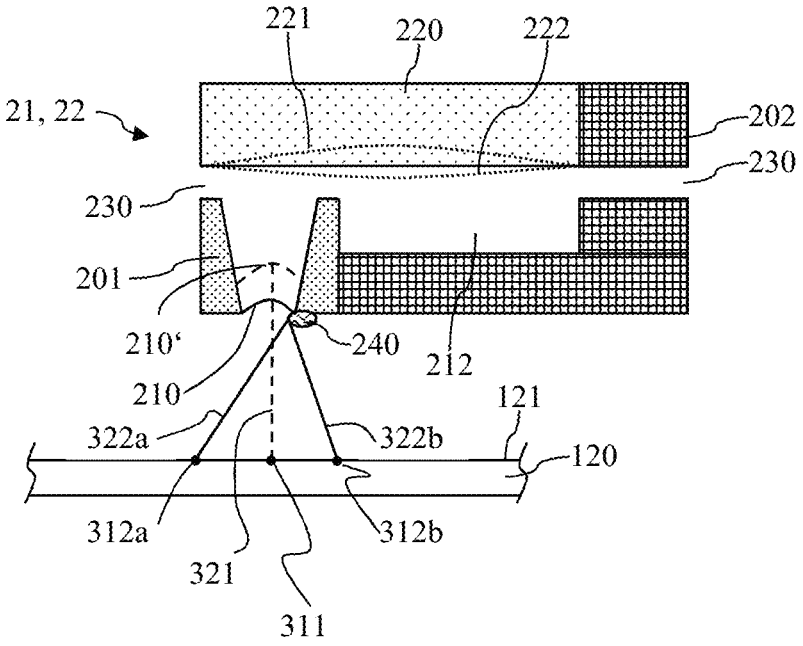

FIG. 2 an example of a design of a nozzle according to an exemplary embodiment.

Figure 3:
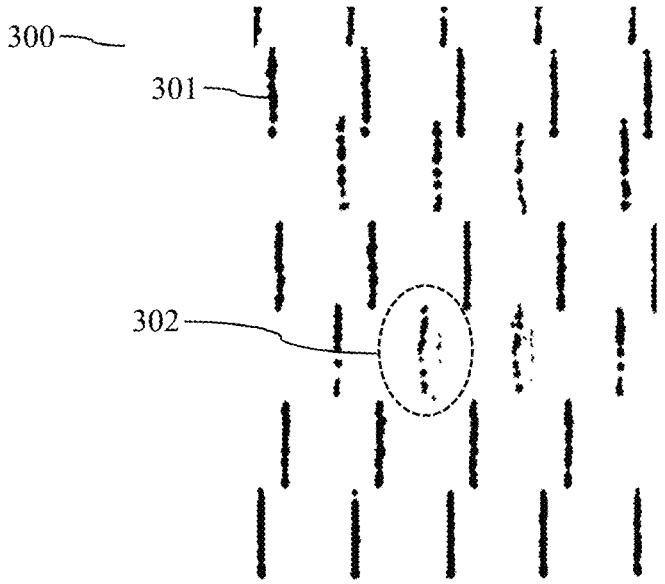

FIG. 3 an example of a print image having a line pattern according to an exemplary embodiment.

Figure 4A:
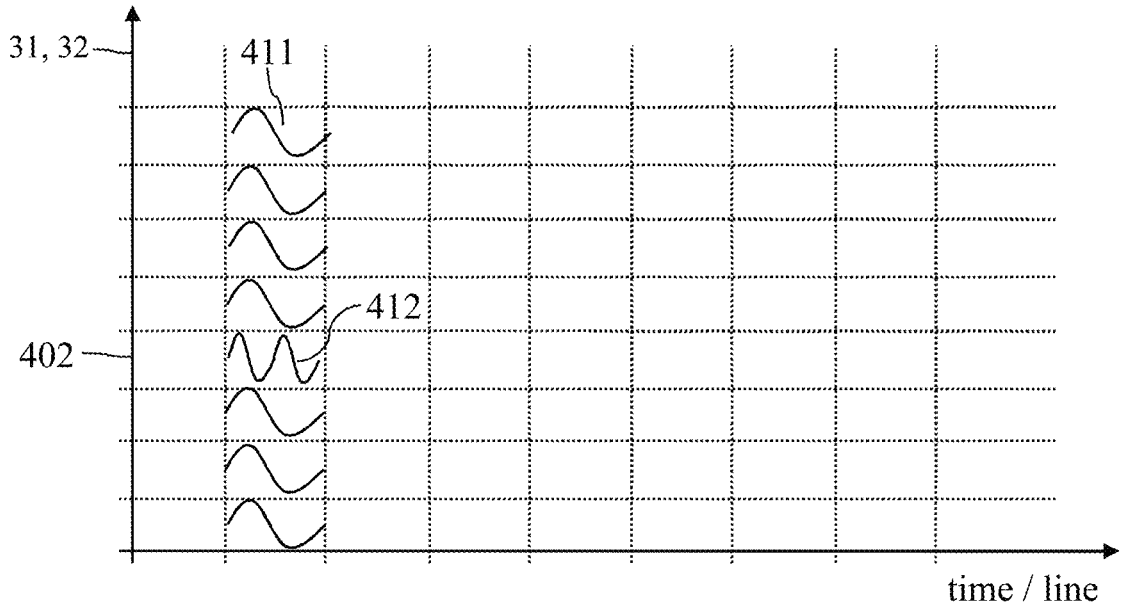

FIG. 4*a* a plot of examples of activation pulses for activating the nozzles of a print head according to an exemplary embodiment.

Figure 4B:
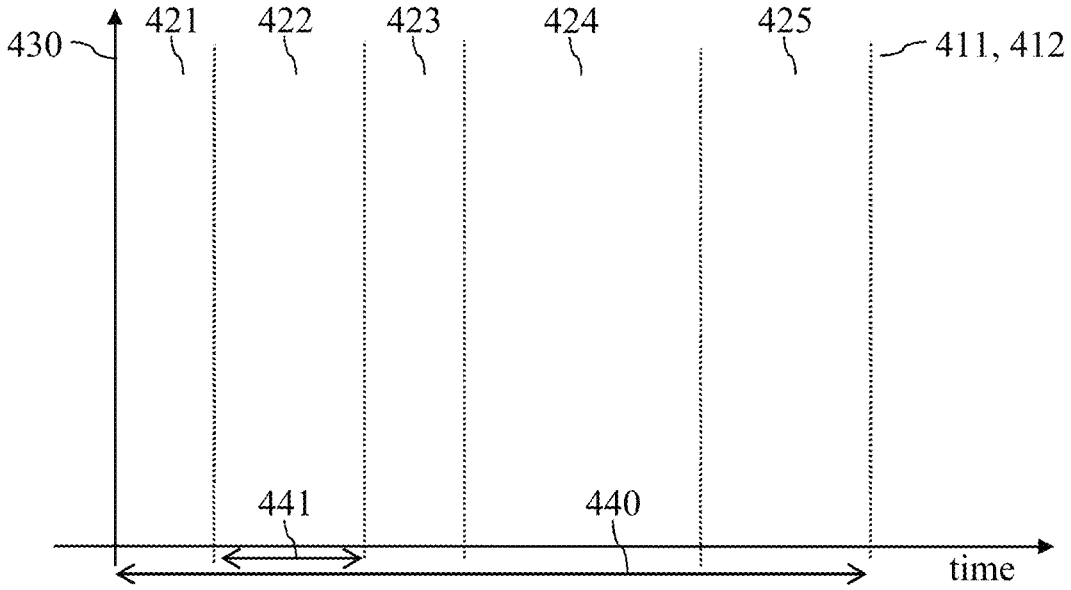

FIG. 4*b* a plot of examples of phases of an activation pulse according to an exemplary embodiment.

Figure 5:
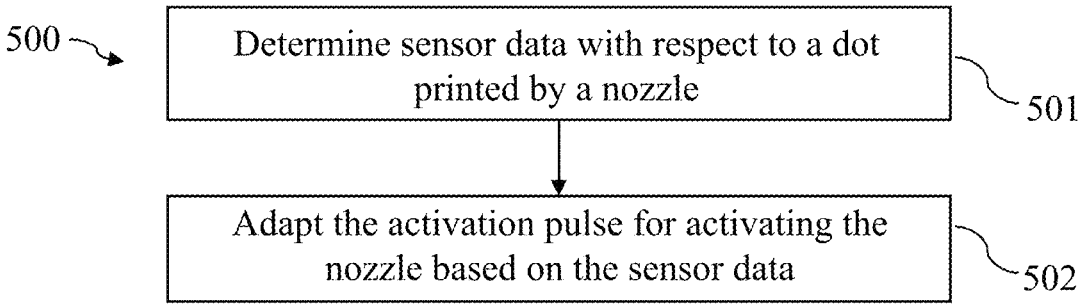

FIG. 5 flowchart of a method for adapting the activation pulse of a nozzle according to an exemplary embodiment.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

An object of the present disclosure is to detect and at least partially compensate for a negative effect on the droplet formation of a nozzle in order to enable a continuous high print quality of an inkjet printing device.

According to one aspect of the disclosure, a device is described for increasing the print quality of an inkjet printing device, which inkjet printing device comprises at least one nozzle that is configured to produce, in reaction to an activation pulse, an ink ejection to print a dot of a print image on a recording medium. The device is configured to determine sensor data with respect to at least one dot printed by the nozzle. Furthermore, the device is configured to adapt the activation pulse, depending on the sensor data, for printing a subsequent dot.

According to a further aspect of the disclosure, a method is described for increasing the print quality of an inkjet printing device that comprises at least one nozzle that is configured to produce, in reaction to an activation pulse, an ink ejection for printing a dot of a print image on a recording medium. The method includes the determination of sensor data with respect to at least one dot printed by the nozzle. Furthermore, the method includes the adaptation of the activation pulse, depending on the sensor data, for printing a subsequent dot.

The printing device (printer) 100 depicted in FIG. 1 is designed for printing to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed along the transport direction 1, represented by an arrow, through the print group 140 of the printing device 100.

In the depicted example, the print group 140 of the printing device 100 comprises two print bars 102, wherein each print bar 102 may be used for printing with ink of a defined color, for example black, cyan, magenta, and/or yellow, and if applicable MICR ink. Different print bars 102 may be used for printing with different respective inks. Moreover, the printing device 100 may comprise a sensor 150 that is configured to capture sensor data with respect to a print image printed on the recording medium 120, in particular with respect to a test print image described in this document. Furthermore, the printing device 100 typically comprises at least one fixer or dryer that is configured to fix a print image printed onto the recording medium 120.

A print bar 102 may comprise one or more print heads 103 that are arranged side by side in a plurality of rows in order to print the dots of different columns 31, 32 of a print image onto the recording medium 120. In the example depicted in FIG. 1, a print bar 102 comprises five print heads 103, wherein each print head 103 prints the dots of a group of columns 31, 32 of a print image onto the recording medium 120. The number of print heads 103 of a print bar 102 may be 5, 10, or more, for example.

In the embodiment depicted in FIG. 1, each print head 103 of the print group 140 comprises a plurality of nozzles 21, 22, wherein each nozzle 21, 22 is configured to fire or eject ink droplets onto the recording medium 120. A print head 103 of the print group 140 may, for example, comprise multiple thousands of effectively utilized nozzles 21, 22 that are arranged along a plurality of rows transverse to the transport direction 1 of the recording medium 120. By means of the nozzles 21, 22 of a print head 103 of the print group 140, dots of a line of a print image may be printed onto the recording medium 120 transverse to the transport direction 1, meaning along the width of the recording medium 120.

The printing device 100 also comprises a controller 101 (e.g., an activation hardware and/or a processer) that is configured to activate the actuators of the individual nozzles 21, 22 of the individual print heads 103 of the print group 140 in order to apply the print image onto the recording medium 120 depending on print data. In an exemplary embodiment, the controller 101 includes processing circuitry that is configured to perform one or more functions and/or operations of the controller 101, including, for example, activating one or more actuators, processing print data (and/or other data), and/or controlling the overall operation of the controller 101.

The print group 140 of the printing device 100 thus comprises at least one print bar 102 having K nozzles 21, 22, wherein the nozzles 21, 22 may be arranged in one or more print heads 103, and wherein the nozzles 21, 22 may be activated with a defined line timing or at a defined activation frequency in order to print a line traveling transverse to the transport direction 1 of the recording medium 120 with K pixels or K columns 31, 32 of a print image onto the recording medium 120, for example with K>1000. In the depicted example, the nozzles 21, 22 are immobile or permanently installed in the printing device 100, and the recording medium 120 is directed past the stationary nozzles 21, 22 with a defined transport velocity.

FIG. 2 shows an example of a design of a nozzle 21, 22 of a print head 103. The nozzle 21, 22 comprises walls 202 which, together with an actuator 220, form a container or a pressure chamber 212 to receive ink. An ink droplet may be fired onto the recording medium 120 via a nozzle opening 201 of the nozzle 21, 22. The ink at the nozzle opening 201 forms what is known as a meniscus 210. Furthermore, the nozzle 21, 22 comprises an actuator 220, for example a piezoelectric element, wherein the actuator 220 is configured to vary the volume of the pressure chamber 212 to receive the ink, or to vary the pressure in the pressure chamber 212 of the nozzle 21, 22. In particular, as a result of a deflection 222, the volume of the pressure chamber 212 may be reduced and the pressure in the pressure chamber 212 may be increased via the actuator 220. An ink droplet is thus ejected from the nozzle 21, 22 via the nozzle opening 201. Moreover, as represented by the deflection 221, the volume of the pressure chamber 212 may be increased via the actuator 220 in order to draw ink into the pressure chamber 212 via an ink supply channel 230.

During the printing operation, it may occur that individual nozzles 21, 22 exhibit increased angle errors or what are known as X-split effects (with a bisection of the jet produced by a nozzle 21, 22). FIG. 3 shows an example of a print image 300 with a plurality of lines 301, wherein the individual lines 301 have respectively been printed by a nozzle 21, 22. The individual lines 301 respectively travel along a column 31, 32 and have a plurality of dots in a corresponding plurality of rows. FIG. 3 also shows a line 302 having an X-split effect. An X-split effect may, for example, be caused by a soiling 240 at a nozzle opening and/or by an asymmetrical wetting of the nozzle surface. A visible defect of a print image 300 may be produced by an X-split effect, for example as lighter streaks in a full-tone image.

The sensor 150, for example a camera, of the printing device 100 may be configured to capture sensor data with respect to a print image printed by the print group 140. The controller 101 of the printing device 100 may be configured to detect, on the basis of the sensor data, a nozzle 21, 22 having a droplet formation defect, in particular having an X-split effect. The detected nozzle 21, 22 may thereupon be deactivated, and the activation of the one or more active nozzles 21, 22 may be adapted in order to at least partially compensate for the deactivated nozzle 21, 22. A compensation of deactivated nozzles 21, 22 via adjacent nozzles, i.e. via what is known as a Nozzle Failure Compensation algorithm, is thereby typically possible only for a limited number of nozzles 21, 22. Alternatively or additionally, within the scope of a maintenance or service process, a print head flushing may be performed in order to remedy a droplet formation defect of the nozzle 21, 22. However, this leads to an increased ink consumption, and to a reduced productivity of the printing device 100.

A nozzle 21, 22 is activated to eject an ink droplet, or to print a dot, with a defined activation pulse via which the actuator 220 of the nozzle 21, 22 is excited into a defined movement. FIG. 4*a* shows, by way of example, how the nozzles 21, 22 of a printer housing 103 are activated to print dots in different columns 31, 32 of a row with a respective activation pulse 411, 412. The quantity of ink for an ink droplet may be defined by an activation pulse 411, 412. In particular, a nozzle 21, 22 may be configured to be activated with different activation pulses 411, 412 for different droplet sizes or ink quantities.

As depicted by way of example in FIG. 4*b*, an activation pulse 411, 412 may have different phases 421, 422, 423, 424, 425 with at least partially different functions. In the depicted example, the activation pulse 411, 412 has five different phases 421, 422, 423, 424, 425. One or more phases 422, 424 may be used to define the droplet size of an ejected droplet. One or more other phases 423, 425 may be used to define how a droplet releases from the opening 201 of the nozzle 21, 22. An activation pulse 411, 412 may have one or more pulse parameters with which properties of an ink droplet, such as the droplet size and/or the droplet break-off, may be adjusted or established. Examples of pulse parameters are

- the voltage 430, in particular the time curve of the voltage 430, of the activation pulse 411, 412 in the individual phases 421, 422, 423, 424, 425; and/or
- the chronological duration 441 of the individual phases 421, 422, 423, 424, 425, in particular relative to the total duration 440 of the activation pulse 411, 412.

For each type of activation pulse 411, 412, values for the one or more pulse parameter may be established, in particular experimentally, in advance of the usage of the printing device 100.

During the operation of the printing device 100, it may be detected, in particular on the basis of the sensor data of the sensor 150, that the ink ejection of a defined nozzle 402 of the printing device 100 is negatively affected. In particular, it may be detected that a defined nozzle 402 exhibits an X-split effect. In reaction to this, the activation pulse 411, 412 for operation of the identified nozzle 402 may be adapted in order to at least partially or entirely remedy the negative effect on the ink ejection, in particular in order to remedy the X-split effect.

The controller 101 of the printing device 100 may, for example, be configured to select an alternative activation pulse 412 for the identified nozzle 402 from a list of predefined activation pulses 411, 412. The list of predefined activation pulses 411, 412 may thereby have a respective plurality of different activation pulses 411, 412 for a defined ink quantity or droplet size. The different activation pulses 411, 412 may be defined for different degrees of soiling 240 of a nozzle 21, 22. In particular, the activation pulse 411, 412 for a defined degree of soiling 240 may be designed such that the negative effect on the ink ejection is reduced, in particular minimized, for the defined degree of the soiling 240, for example in comparison to the use of a standard activation pulse 411 that is used for nozzles 21, 22 that exhibit no soiling 240.

Given detection of a nozzle 402 with negatively affected ink ejection, an alternative activation pulse 412 may thus be selected or determined that is optimized for the current degree and/or for the current form of the soiling 240 of the nozzle 402, in order to reduce—in particular to minimize or entirely correct—the effects of the soiling 240 on the ink ejection.

The selection or the determination of a suitable activation pulse 412 may take place on the basis of the sensor data of the sensor 150 with respect to the print image 302 produced by the identified nozzle 402. In particular, the type of the negative effect on the ink ejection may be determined on the basis of the sensor data. An activation pulse 412 that is optimized for the type of the negative effect may then be determined or selected on this basis. For this purpose, a machine-learning assignment unit or adaptation unit may be used in advance that, for example, comprises one or more neural networks and is configured to determine an activation pulse 412 on the basis of the sensor data, in particular to select from the list of predefined activation pulses 411, 412 via which the negative effect on the ink ejection that is indicated by the sensor data is reduced, in particular is minimized.

The droplet generation pulse 411, 412 for an identified nozzle 402 may thus be adapted such that the droplet break-off takes place at a modified point in time (in particular a later point in time). With the shifting of the droplet break-off to a later point in time, the original meniscus 210 is displaced inward (see the newly displaced meniscus 210' in FIG. 2). As has already been presented above, the droplet formation process may consist of different phases, in particular five different phases 421, 422, 423, 424, 425. The droplet size may thereby be defined by one or more phases 422, 424, wherein the droplet size may be enlarged by increasing the duration 411 of the one or more phases 422, 424, or wherein the droplet size may be reduced by reducing the duration 411 of the one or more phases 422, 424.

The droplet break-off of an ink droplet may be influenced, and/or the form of the droplet break-off may be established, via one or more different phases 423, 425. The X-split effect may occur in particular when the droplet break-off is distorted at the nozzle edge, for example by a soiling 240. For example, this may happen when the meniscus 210 is in contact with the soiling 240 (see FIG. 2). If the actuator 220 (for example piezoelectric element or thermoelement) now receives an activation pulse 411, 412, the meniscus 210 is bulged outward and is distorted by the soiling 240 such that, instead of one droplet, two droplets with different flight paths 322*a* and 322*b* are created that are represented as a solid line in FIG. 2. These flight paths 322*a* and 322*b* most often travel at an angle (in the transverse plane relative to the transport direction 1) to the surface 121 of the recording medium 120. The two droplets leave two dots 312*a* and 312*b* on the recording medium 120, which dots represent a portion of the line 302 with X-split.

Via an adaptation of the one or more phases 423, 425, the position and/or the velocity of the meniscus 210 may be modified so that the disruption of the ink ejection due to the soiling 240 is no longer visible. For example, due to modified activation parameters, the original position of the meniscus 210 may be drawn into the nozzle opening 201 until the new meniscus 210' (represented by a dashed line) no longer has contact with the soiling 240 (for example a dried clump of ink here at the edge of the nozzle opening 201). If the actuator 220 (for example a piezoelectric element or thermoelement) now receives an activation pulse 411, 412, the inwardly shifted meniscus 210' is now bulged outward. However, the displaced meniscus 210' is no longer disrupted by the soiling 240. At least one droplet is created, wherein its flight path 321 (depicted with a dashed line) travels essentially orthogonally (as viewed in the transverse plane with respect to the transport direction 1) to the surface 121 of the recording medium 120 and, on said recording medium 120, creates only a single dot 311 that represents a portion of the line 301. A plurality of droplets may also be created that, in the flight phase, merge into one very large droplet, such that only a single (large) dot is generated on the recording medium 120.

After a nozzle 402 that has an X-split effect has been detected, this nozzle 402 may be operated or charged with one or more adapted activation pulses 412 in one or more subsequent test print images 300 that are inserted repeatedly, in particular periodically, between usable print images, for instance every 100 m. In particular, the duration 441 of one or more phases 423, 425 may thereby be modified. On the basis of the sensor data of the sensor 150, a check may then be made as to whether the X-split effect might be reduced or entirely avoided via an adapted activation pulse 412. In the event that an improvement of the print quality of the negatively affected nozzle 402 is detected, the activation pulse 412 may be adapted until an optimized print quality, for example in which an X-split effect is no longer present, is established on a test print image 300. An activation pulse 412 via which the print quality of a negatively affected nozzle 402 is increased again, in particular is optimized, may thus be identified or determined, in particular via printing tests with different activation pulses 412. The determined activation pulse 412 is then used for the further printing operation of the nozzle 402.

After a negatively affected nozzle 402 has been identified, and during the process to discover an adapted and/or optimized activation pulse 412 for the negatively affected nozzle 402, said negatively affected nozzle 402 may be deactivated for the printing of usable print images. If applicable, the negatively affected nozzle 402 may then be used only for the printing of test print images 300. In this time period, effects of the deactivated nozzle 402 on the print quality may be reduced or compensated via a Nozzle Failure Compensation (NFC) method. After a suitable activation pulse 412 for the negatively affected nozzle 402 has been determined, the nozzle 402 may be used with the adapted activation pulse 412 for the printing of usable print images.

FIG. 5 shows a workflow diagram of a method 500, if applicable a computer-implemented method 500, to increase the print quality of an inkjet printing device 100. The printing device 100 comprises at least one nozzle 21, 22 that is configured to produce, in reaction to an activation pulse 411, an ink ejection to print a dot of a print image 300 on a recording medium 120. The printing device 100 typically has a plurality of nozzles 21, 22 for printing the dots in a corresponding plurality of columns 31, 32 of a print image 300.

The method 500 includes the determination 501 of sensor data with respect to at least one dot printed by the nozzle 21, 22. The sensor data are thereby captured by a sensor 150, in particular by a camera or by an inline scanner, of the printing device 100. The sensor data may indicate the shape of the dot printed by the nozzle 21, 22. In particular, the sensor data may indicate whether the printed dot exhibits a split, in particular a division or an X-split. In other words, whether a negative effect on the ink ejection of the nozzle 21, 22 is present may be determined on the basis of the sensor data. Such a negative effect may be produced via a soiling 240 at the edge of the nozzle opening 201 of the nozzle 21, 22.

The method 500 also includes the adaptation 502 of the activation pulse 412 for printing a subsequent dot depending on the sensor data. In particular, whether the activation pulse 412 is adapted or not may be decided depending on the sensor data, for example if it is detected that a negative effect on the ink ejection is present. The actual adaptation of the activation pulse 412 and/or the selection of a different or adapted activation pulse 412 may also take place depending on the sensor data.

For example, a regulation of the print quality of the nozzle 21, 22 may take place on the basis of the sensor data. The adaptation of the activation pulse 411, 412, in particular the adaptation of the values of one or more pulse parameters, may thereby be used as an actuating variable. The controlled variable may be the shape of a printed dot. The activation pulse 411, 412 may, for example, be repeatedly adapted in order to have the effect that the dots printed by the nozzle 21, 22 respectively have a defined desired shape. In particular, as a desired shape it may be defined that the dots are in one piece and exhibit no X-split effect.

In other words, a method 500 is described that enables the activation pulse 411, 412, with which a nozzle 21, 22 of an inkjet printing device 100 is activated in order to print dots onto a recording medium 120, to be adapted on the basis of sensor data with respect to one or more already printed dots. Via the automatic adaptation of the activation pulses 411, 412 on the basis of the quality or on the basis of one or more properties of already printed dots, a continuously high print quality may be produced, even given the presence of soiling 240 at the nozzle 21, 22.

The present disclosure also describes a device for increasing the print quality of an inkjet printing device 100, wherein the printing device 100 comprises at least one nozzle 21, 22 that is configured to produce, in reaction to an activation pulse 411, a respective ink ejection to print a dot of a print image 300 onto a recording medium 120. The nozzle 21, 22 may, for example, be designed to print the dots of a defined column 31, 32 of the print image 300. For this purpose, the recording medium 120 may be moved relative to the (possibly stationary) nozzle 21, 22.

The controller 101 may be configured to receive sensor data with respect to at least one dot printed by the nozzle 21, 22 from the sensor 150 and process the received sensor data. The sensor data may be determined with respect to a line 302 printed by the nozzle 21, 22 within a column 31, 32 of the print image 300. The sensor data may, for example, comprise an image of the one or more printed dots. The controller 101 may be configured to determine, on the basis of the sensor data, whether the ink ejection of the nozzle 21, 22 is negatively affected or not. In particular, the controller 101 may be configured to determine, on the basis of the sensor data, whether the one or more dots printed by the nozzle 21, 22 are subdivided into a plurality of sub-regions that are separate from one another, and/or whether the nozzle 21, 22 exhibits an X-split effect. If this is so, it may be concluded therefrom that the ink ejection of the nozzle 21, 22 is negatively affected, for example by a contamination 240 at the nozzle opening of the nozzle 21, 22.

The controller 101 may also be configured to adapt the activation pulse 412 for printing a subsequent dot depending on the sensor data. In particular, an adaptation of the activation pulse 412 may take place if it is detected that the ink ejection of the nozzle 21, 22 is negatively affected. The adaptation of the activation pulse 412 may thereby take place with the purpose of reducing or entirely correcting the negative effect on the ink ejection.

The controller 101 may be configured, in particular depending on the sensor data, to select the activation pulse 412 for printing a subsequent dot from a list of predefined activation pulses 411, 412. The list of predefined activation pulses 411, 412 may thereby include a plurality of different activation pulses 411, 412 to produce an ink ejection with a uniform, defined ink quantity. In other words, the list may have a plurality of different activation pulses 411, 412, for example 20 or more, or 30 or more, for a defined ink quantity.

The different activation pulses 411, 412 may thereby be designed to respectively produce, given different degrees and/or forms of a soiling 240 of the nozzle 21, 22, the respective printing of a dot with a print quality optimized for the respective degree and/or for the respective form of the soiling 240. For different degrees and/or forms of soiling 240 of the nozzle 21, 22, different activation pulses 411, 412 may thus be provided that enable an optimized print quality and/or an optimally small negative effect on the ink ejection for the respective degree and/or the respective form of soiling 240. The different activation pulses 411, 412 may have been experimentally determined in advance and have been stored on a storage unit of the printing device 100.

An adaptation of the activation pulse 411, 412 may be particularly reliably enabled by providing a list of predefined activation pulses 411, 412 for different degrees and/or forms of soiling 240 of the nozzle 21, 22.

In order to print a respective dot, the controller 101 may be configured to operate the nozzle 21, 22 with a respective differently adapted activation pulse 411, 412 at a first and a subsequent second point in time. Dots may thus be printed with different activation pulses 411, 412. The dots may thereby be printed within the scope of one or more test print images 300. The one or more test print images 300 may include a line 302 printed by the nozzle 21, 22. In particular, the one or more test print images 300 may have lines 301, 302 in different columns 31, 32 that have been printed by different nozzles 21, 22 of the printing device 100.

The controller 101 may also be configured to receive sensor data with respect to the dots printed at the first and second point in time from the sensor 150 and to process the received sensor data. Via which of the activation pulses 411, 412 the negative effect on the ink ejection may be reduced may then be checked on the basis of the sensor data. In particular, on the basis of the sensor data with respect to the dots printed at the first and second point in time, a decision may be made as to whether the activation pulse 411, 412 that is used at the second point in time is used for printing a subsequent dot. The activation pulses 411, 412 may thereby be selected via which the negative effect on the ink ejection might be most strongly reduced. Alternatively or additionally, how the activation pulse 411, 412 for printing the subsequent dot is to be further adapted may be determined on the basis of the sensor data with respect to the dots printed at the first and second point in time. In particular, a direction for the further adaptation of a value of at least one pulse parameter may be determined.

Repeated adaptations of the activation pulse 411, 412 may thus be performed and reviewed in order to determine, bit by bit, an optimized activation pulse 411, 412 via which the negative effect on the ink ejection may be reduced to a particular degree.

The controller 101 may be configured to determine the adapted activation pulse 411, 412 for printing the subsequent dot by means of a machine-learning adaptation unit. The adaptation unit may thereby have been trained in advance using training data. The adaptation unit may be designed to provide, on the basis of a feature vector depending on sensor data of the sensor 150, how an activation pulse 411, 412 is to be adapted in order to at least partially compensate for a negative effect on the ink ejection of the nozzle 21, 22, as indicated by the sensor data. The discovery of an optimized activation pulse 411, 412 to reduce the negative effect on the ink ejection may thus be further improved.

The activation pulse 411, 412 may comprise at least one ink break-off phase 423, 425 via which the position and/or the movement velocity of the ink meniscus 210 of the nozzle 21, 22 is influenced and/or established. The controller 101 may be configured to adapt the value of at least one pulse parameter of the activation pulse 411, 412 within the ink break-off phase 423, 425 in order to determine the adapted activation pulse 411, 412 for printing a subsequent dot. Examples of pulse parameters are thereby: the duration 441 of the ink break-off phase 423, 425, relative to the total duration 440 of the activation pulse 411, 412; and/or the energy and/or the electrical voltage 430, in particular the time curve of the electrical voltage 430, of the activation pulse 411, 412 during the ink break-off phase 423, 425. The position of the meniscus 210 and/or the point in time of the ink break-off given an ink ejection may be influenced by adapting the values of one or more pulse parameters of the activation pulse 411, 412. A compensation of a negative effect on the ink ejection may thus be produced in a precise manner via adaptation of an activation pulse 411, 412.

As has already been presented above, the printing device 100 preferably comprises a plurality of nozzles 21, 22 for printing dots in a corresponding plurality of columns 31, 32 of the print image 300. The controller 101 may be configured to determine (e.g. process) sensor data (e.g. received from the sensor 150) with respect to the dots printed by the plurality of nozzles 21, 22. The controller 101 may also be configured to identify, on the basis of the sensor data, from a plurality of nozzles 21, 22 a nozzle 402 that exhibits a negatively affected droplet ejection, in particular that exhibits an X-split effect.

The controller 101 may also be configured to selectively adapt the activation pulse 412 for operation of the identified nozzle 402 to print a subsequent dot. On the other hand, the controller 101 may be configured to leave the activation pulses 411 for operating the one or more other nozzles 21, 22 from the plurality of nozzles 21, 22 unmodified for the printing of one or more subsequent dots.

A selective adaptation of the activation pulses 411, 412 for nozzles 21, 22 that exhibit a negatively affected ink ejection may thus be implemented. A high print quality of the printing device 100 may thus be particularly reliably and efficiently produced.

The controller 101 may be configured to deactivate the identified nozzle 402 for the printing of a usable print image. The identified nozzle 402 may in particular remain deactivated until an optimized activation pulse 412 may be determined via which the negative effect on the ink ejection of the identified nozzle 402 may be at least partially or entirely compensated. The printing device 100 may be configured to implement an NFC method while the identified nozzle 402 is deactivated for the printing of usable print images. A high print quality may thus be provided even given a deactivated nozzle 402.

The identified nozzle 402 may be operated for the printing of one or more test print images 300 with a plurality of different activation pulses 411, 412 in order to determine an optimized activation pulse 411, 412 via which the negative effect on the ink ejection of the identified nozzle 402 is reduced, in particular is minimized. The one or more test print images 300 may thereby optionally be printed repeatedly between usable print images.

The identified nozzle 402 may then be operated for the printing of one or more usable print images with the optimized activation pulse 411, 412. A reactivation of the identified nozzle 402 for the printing of one or more usable print images may thus take place. The identified nozzle 402 is thereby operated with the optimized activation pulse 411, 412 so that the identified nozzle 402 exhibits no or at least a reduced negative effect on the ink ejection.

An identified negatively affected nozzle 21, 22 may thus be deactivated, and an adaptation of the activation or droplet generation pulse 412 may take place during the printing of at least one test print image 300. The adaptation may in particular take place such that the droplet break-off occurs later, which may be produced via the adaptation of the position and/or the velocity of the meniscus 210. For example, the position of the meniscus 210 in the nozzle 21, 22 may be shifted, for example be moved further inward. The adaptation of the activation pulse 412 may take place until the X-split of the printed dots disappears. When this is so, a reactivation of the nozzle 21, 22 for the printing of a usable print image may take place.

The print quality of a printing device 100 may be increased via the measured described in this document. The productivity of a printing device 100 may also be increased, since printing stops for maintenance purposes may be avoided. Furthermore, spoilage may be reduced. The required computing power of the controller 101 of the printing device 100 may also be reduced, since the computationally expensive use of an NFC method may be reduced. The adaptation of the activation pulses 411, 412 may take place in a resource-efficient manner by means of an FPGA (Field Programmable Gate Array), for instance via selection from a list of predefined activation pulses 411, 412.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processing circuitry" shall be understood to be circuit(s) or processor(s), or a combination thereof. A circuit includes an analog circuit, a digital circuit, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein. In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM).

The memory can be non-removable, removable, or a combination of both.

REFERENCE LIST

1 transport direction (of the recording medium)
2 movement direction (of a print bar)
21, 22 nozzle
31, 32 column (of the print image)
100 printing device
101 controller
102 print bar
103 (usable) printer housing
120 recording medium
140 print group
150 sensor
201 nozzle opening
202 wall
210 meniscus
212 chamber
220 actuator (piezoelectric element)
221, 222 deflection of the actuator
230 ink supply channel
240 soiling
300 print image
301 printed line
302 line with X-split
402 column/nozzle with negatively affected droplet formation
411, 412 activation pulse or droplet generation pulse
421-425 phase of an activation pulse
430 actuator voltage
440 total length or total duration of an activation pulse
441 length or duration of a phase
500 method for adapting an activation pulse of a nozzle
501-502 method steps

The invention claimed is:

1. A device for increasing the print quality of an inkjet printing device having at least one nozzle and being configured to produce, in reaction to an activation pulse, an ink ejection to print a dot of a print image on a recording medium, the device comprising:

an interface configured to receive sensor data corresponding to at least one dot printed by the at least one nozzle; and processing circuitry configured to adapt the activation pulse for printing a subsequent dot based on the sensor data by:

determining, based on the sensor data, that the ink ejection of the at least one nozzle is negatively affected; and adapting the activation pulse for printing the subsequent dot based on the determination, wherein the processing circuitry is configured to detect, based on the sensor data, that:

the at least one nozzle exhibits an X-split dot division in which a single dot is divided into a plurality of dots having flight paths at different angles in a transverse direction to a transport direction of the recording medium, the X-split dot division being indicative of the ink ejection of the at least one nozzle being negatively affected.

2. The device according to claim 1, wherein the processing circuitry is configured to detect, based on the sensor data, that:

the dot printed by the at least one nozzle is subdivided into a plurality of sub-regions that are separate from one another.

3. The device according to claim 1, wherein the processing circuitry is configured to select, based on the sensor data, the activation pulse for printing the subsequent dot from a list of predefined activation pulses.

4. The device according to claim 3, wherein:

the list of predefined activation pulses comprises a plurality of different activation pulses for producing an ink ejection with a uniform, defined ink quantity; and given different degrees and/or forms of a soiling of the at least one nozzle, the different activation pulses are configured to respectively produce the printing of a dot with a print quality optimized for the respective degree and/or for the respective form of the soiling.

5. The device according to claim 1, wherein the processing circuitry is configured to:

operate the at least one nozzle with a respective different adapted activation pulse at a first and a subsequent second point in time to print a respective dot;

process sensor data with respect to the dots printed at the first and second point in time; and based on the sensor data with respect to the dots printed at the first and second point in time:

determine whether the activation pulse used at the first point in time or at the second point in time is used for printing the subsequent dot; and/or determine a further adaptation of the activation pulse for printing of the subsequent dot.

6. The device according to claim 1, wherein:

the activation pulse comprises at least one ink break-off phase via which a position and/or a movement velocity of an ink meniscus of the at least one nozzle is influenced and/or established;

the processing circuitry is configured to adapt a value of at least one pulse parameter of the activation pulse within the ink break-off phase to determine the adapted activation pulse for printing of the subsequent dot; and the at least one pulse parameter includes:

a duration of the ink break-off phase; and/or an energy and/or an electrical voltage of the activation pulse during the ink break-off phase.

7. The device according to claim 1, wherein:

the printing device comprises a plurality of nozzles for printing of dots in a corresponding plurality of columns of the print image; and the processing circuitry is configured to:

process sensor data with respect to the dots printed by the plurality of nozzles;

identify a nozzle from the plurality of nozzles, based on the sensor data, that exhibits a negatively affected droplet ejection;

selectively adapt an activation pulse for operation of the identified nozzle for printing of a subsequent dot; and maintaining an activation pulses for operating the one or more other nozzles from the plurality of nozzles for the printing of one or more subsequent dots in an unmodified state.

8. The device according to claim 7, wherein the processing circuitry is configured to:

deactivate the identified nozzle for the printing of a usable print image;

operate the identified nozzle for the printing of one or more test print images with a plurality of different activation pulses to determine an optimized activation pulse via which the negative effect on the ink ejection of the identified nozzle is reduced or minimized; and operate the identified nozzle for the printing of a usable print image with the optimized activation pulse.

9. The device according to claim 1, further comprising a sensor that is configured to detect the at least one dot printed by the at least one nozzle and to generate the sensor data based on the detected at least one dot printed by the at least one nozzle.

10. The device according to claim 9, wherein the sensor is a camera.

11. A method for increasing the print quality of an inkjet printing device having at least one nozzle that is configured to produce, in reaction to an activation pulse, an ink ejection for printing a dot of a print image on a recording medium, the method comprising:

determining sensor data corresponding to at least one dot printed by the at least one nozzle;

adapting the activation pulse for printing of a subsequent dot based on the sensor data by determining, based on the sensor data, that the ink ejection of the at least one nozzle is negatively affected and adapting the activation pulse for printing the subsequent dot based on the determination; and detecting, based on the sensor data, that the at least one nozzle exhibits an X-split dot division in which a single dot is divided into a plurality of dots having flight paths at different angles in a transverse direction to a transport direction of the recording medium, the X-split dot division being indicative of the ink ejection of the at least one nozzle being negatively affected.

12. A non-transitory computer-readable storage medium with an executable program stored thereon, that when executed, instructs a processor to perform the method of claim 11.

* * * * *